US007422021B2

(12) United States Patent
Leaphart

(10) Patent No.: US 7,422,021 B2
(45) Date of Patent: Sep. 9, 2008

(54) METHOD OF CLEANING OIL STRAINER

(76) Inventor: Dwight Leaphart, 110 Blackfoot Trail, Leesville, SC (US) 29070

( * ) Notice: Subject to any disclaimer, the term of this patent is extended or adjusted under 35 U.S.C. 154(b) by 0 days.

(21) Appl. No.: 11/227,608

(22) Filed: Sep. 16, 2005

(65) Prior Publication Data

US 2007/0062562 A1 Mar. 22, 2007

(51) Int. Cl.
*B08B 9/093* (2006.01)
*B08B 9/00* (2006.01)

(52) U.S. Cl. ..... 134/22.18; 134/10; 134/22.1; 134/34

(58) Field of Classification Search ..... 134/10, 134/22.1, 22.18, 34, 22.12, 169 A
See application file for complete search history.

(56) References Cited

U.S. PATENT DOCUMENTS 4,406,784 A 9/1983 Cochran
4,951,784 A 8/1990 Bedi
5,062,398 A 11/1991 Bedi et al.
5,090,376 A 2/1992 Bedi
5,094,201 A 3/1992 Bedi
5,145,033 A 9/1992 Bedi et al.
5,154,775 A 10/1992 Bedi
5,190,120 A 3/1993 Watts
5,263,445 A 11/1993 Bedi et al.
5,327,862 A 7/1994 Bedi
5,462,679 A * 10/1995 Verdegan et al. ..... 210/798
5,476,154 A 12/1995 Sage
5,526,782 A 6/1996 Bedi et al.
5,566,781 A 10/1996 Robert et al.
5,665,171 A 9/1997 Leaphart
5,676,842 A 10/1997 Bedi et al.
5,685,396 A 11/1997 Elkin et al.
5,743,358 A 4/1998 Bedi et al.
5,787,372 A 7/1998 Edwards et al.
5,816,272 A 10/1998 Leaphart
5,900,155 A 5/1999 Bedi
5,957,170 A 9/1999 Bedi et al.
5,964,256 A 10/1999 Bedi et al.
6,021,867 A 2/2000 Krawczyk et al.
6,213,173 B1 4/2001 Bedi et al.
6,298,947 B1 10/2001 Flynn
6,449,948 B2 9/2002 Soga et al.
6,561,219 B1 5/2003 Apostolides
6,651,777 B2 11/2003 Suratt
2001/0032754 A1 10/2001 Bedi et al.
2001/0045221 A1 11/2001 Soga et al.
2003/0079943 A1 5/2003 Suratt
2004/0065347 A1 4/2004 Awad

* cited by examiner

*Primary Examiner*—Michael Barr
*Assistant Examiner*—Rita R Patel
(74) *Attorney, Agent, or Firm*—Steptoe & Johnson LLP

(57) ABSTRACT

A method for cleaning an oil strainer in an oil pan of an internal combustion engine from which substantially all lubricant has been drained, the method comprising connecting a first conduit to said oil pan; introducing a cleaning fluid into said oil pan; connecting a second conduit to an opening on said engine; creating a circuit by a pressure pump wherein said cleaning fluid moves from said oil pan, through said opening, through said oil strainer and back into said oil pan; and evacuating the cleaning fluid from the engine.

33 Claims, 5 Drawing Sheets

METHOD OF CLEANING OIL STRAINER

FIELD OF THE INVENTION

The invention is directed to a method for cleaning an oil strainer in an internal combustion engine. In particular, the invention is directed to a method of cleaning an oil strainer by creating a closed circuit that flows in reverse direction of oil during normal engine operation, thereby dislodging contaminates from the oil strainer and removing them from the engine. The inventive method also facilitates the removal of sludge from an engine and reduces the amount of carry-over contamination, thereby reducing engine wear and enhancing engine performance.

BACKGROUND OF THE INVENTION

Combustion engines use oil to lubricate and reduce friction between moving parts such as the camshaft and bearings. As the oil circulates through an engine, it collects contaminants such as carbon and the contaminants eventually settle in the oil pan and become lodged in the oil strainer. When particles and contaminants become lodged within the oil strainer, there is a reduction in the rate of oil flow to the engine. Restricted oil flow causes an engine to become less efficient and can eventually result in engine failure or expensive engine repair.

Sludge, a by-product of engine use, is known to obstruct oil passages and restrict oil flow, ultimately leading to shortened engine life. Typical factors in the formation of sludge include heat, soot, fuel, water, acids, dirt, and engine coolant in the engine block. Although some sludge can be removed from an engine by changing the oil, common oil changing methods do not clean all of the sludge from an oil pan and oil strainer. When new oil is added to the engine, it mixes with the carry-over contaminants. Thus, the new oil is contaminated even before the engine begins to run.

U.S. Pat. Nos. 5,665,171 and 5,816,272, both to Leaphart, are directed to a method and an apparatus for cleaning an oil strainer and pan in an internal combustion engine. U.S. Pat. No. 5,190,120 to Watts is directed to a flushing apparatus for vehicle oil pump pickup tube and screen. The prior art does not address the need to not only remove the restriction and contaminants from the strainer, but also provide an effective means by which to further remove them from the oil pan by adding a strong suction at the drain plug opening. The prior art only displaces the restrictive material and normal engine operation sucks the restrictive material back into the strainer.

Despite these developments, there remains a need for an effective method for clearing a restricted oil strainer, removing sludge from an engine, and reducing the amount of carry-over oil contamination.

SUMMARY OF THE INVENTION

The invention relates to a method for cleaning an oil strainer in an oil pan of an internal combustion engine from which substantially all lubricant has been drained, the method comprising connecting a first conduit to said oil pan; introducing a cleaning fluid into said oil pan; connecting a second conduit to an opening on said engine; creating a circuit by a pressure pump wherein said cleaning fluid moves from said oil pan, through said opening creating enough pressure to hold open the by-pass valve in said oil pump; and then evacuating the cleaning fluid through the oil pump and oil strainer into the oil pan and then from the engine. The pressure pump, which may be a positive displacement pump, creates suction to move the cleaning fluid from the oil pan. The use of suction at the oil plug effectively removes contaminants in the oil pan. Periodic air blasts and changes in pressure create cavitation within the circuit, thereby further assisting the removal of particles. Filter media may be disposed within the conduits connecting the positive displacement pump to the oil plug and the engine.

The invention further relates to a method of reducing oil sludge from an internal combustion engine having an oil pump and an oil strainer disposed with an oil pan, the method comprising draining substantially all lubricant from said engine; connecting a first conduit to said oil pan; introducing a cleaning fluid into said oil pan; connecting a second conduit to an opening on said engine; creating a circuit through said conduits using a pressure pump, wherein said cleaning fluid moves from said oil pan, through said opening, through said oil strainer and back into said oil pan; and evacuating the cleaning fluid from the engine at a pressure greater than gravity.

Another aspect of the invention is a method for reducing the amount of carry-over oil contamination during an oil changing process for an internal combustion engine having an oil strainer and an oil pan, comprising draining substantially all lubricant from said engine; connecting a first conduit to said oil pan; introducing a cleaning fluid into said oil pan; connecting a second conduit to an opening on said engine; creating a hydraulic/pneumatic circuit with a pressure pump wherein said cleaning fluid moves from said oil pan, through said opening, through said oil strainer and back into said oil pan; filtering said cleaning fluid through a filter media disposed in said first conduit; evacuating the cleaning fluid from the engine at a pressure greater than gravity; and introducing a predetermined amount of clean oil to the engine. The pressure pump may be a positive displacement pump, and the first and second conduits may be connected to the pressure pump.

DESCRIPTION OF THE PREFERRED EMBODIMENT

Figure 1:
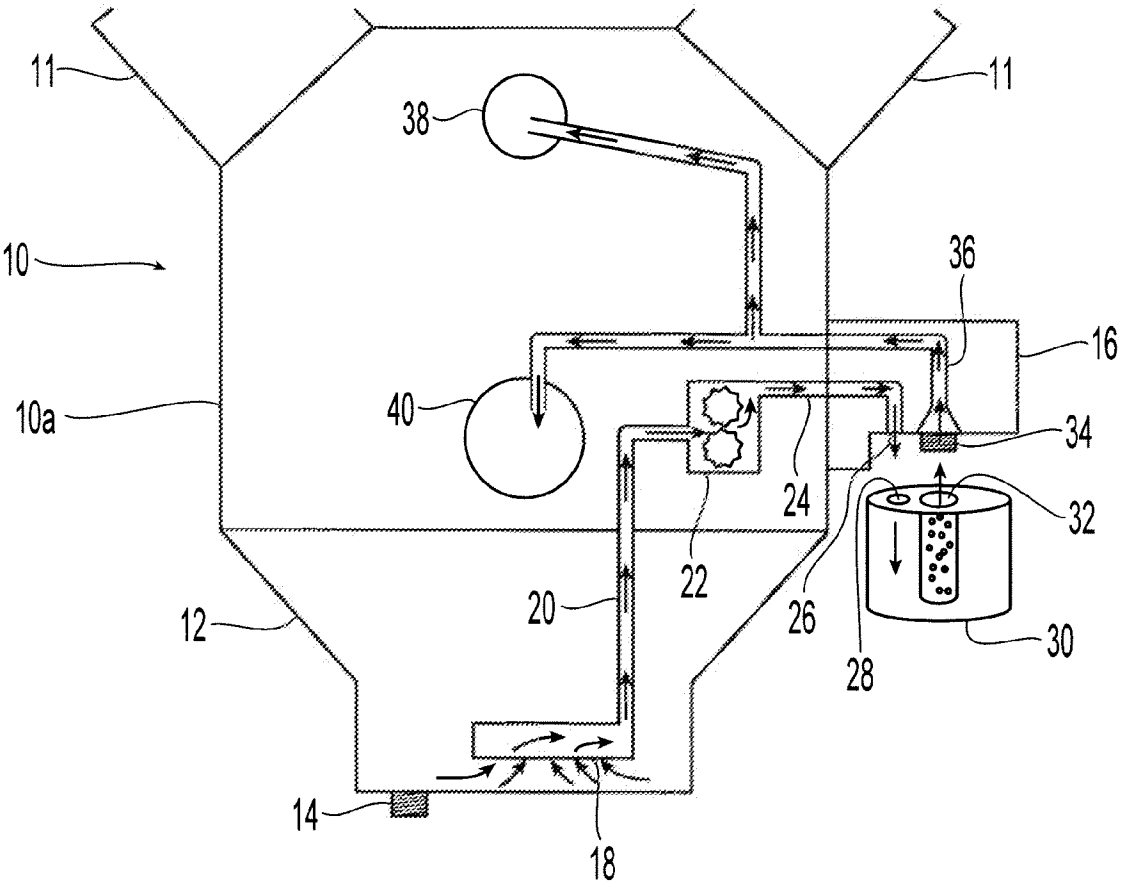
Fig. 1 (Prior Art)
FIG. 1 is a schematic of an engine block, illustrating the normal oil path in an engine block.
Figure 2:
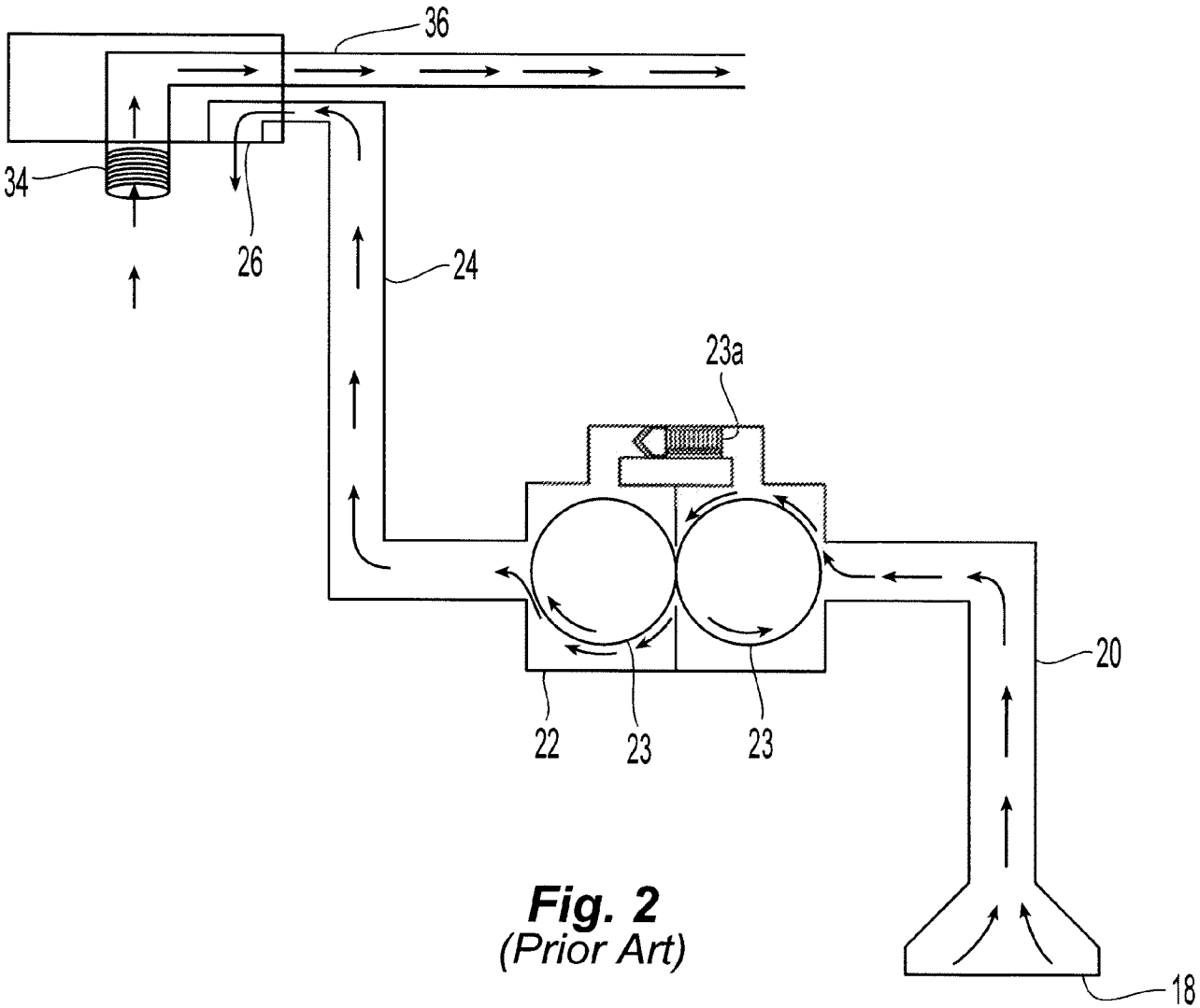
Fig. 2 (Prior Art)
FIG. 2 is a partial cross-sectional view of the normal oil pathway between the oil strainer and oil filter.

Referring initially to FIGS. 1 and 2, there is illustrated a conventional automobile engine block 10*a* having a pair of engine heads 11. Attached to engine 10 is an oil reservoir or pan 12. Oil pan 12 holds oil that is used in the normal operation of the engine. Oil plug 14 is removably attached at the distal end of oil pan 12. Also attached to engine 10 is an oil filter boss 16.

Suspended within oil pan 12 is oil strainer 18. Uptake tube 20 is connected to oil strainer 18 and extends to oil pump 22. Within oil pump 22 are a pair of interconnected gears 23. Outlet tube 24 extends from oil pump 22 to oil filter boss 16. Filter boss 16 includes oil filter 30 which has an opening 28 to which tube 24 is sealingly connected and an outlet 32 through which filtered oil exits the oil filter 30 into releaseably attached tube 36. Tube 36 extends from oil filter 30 and carries oil to other areas of engine block 10*a*.

During normal engine operation, oil pump 22 draws oil that is resting in oil pan 12 through the oil strainer 18. As oil travels through tube 20 into oil pump 22, it passes through interconnected gears 23 which rotate and pass oil to the oil outlet tube 24. Oil travels under pressure from oil pump 22 through tube 24 to oil filter 30. After the oil passes through oil filter 30, clean oil passes through tube 36 to the pressurized oil passages of the engine, such as cams 38 and mains 40.

Oil pump 22 includes any type of oil pump and may be remote mounted, mounted on engine block 10*a* or the main bearing cap therefor, or built into timing covers, and may be rotated by a crank shaft or any other means. Any engine driven oil pump with an internal by-pass valve (all engine oil pumps with by-pass valves in pressure system) may be used.

Figure 3:
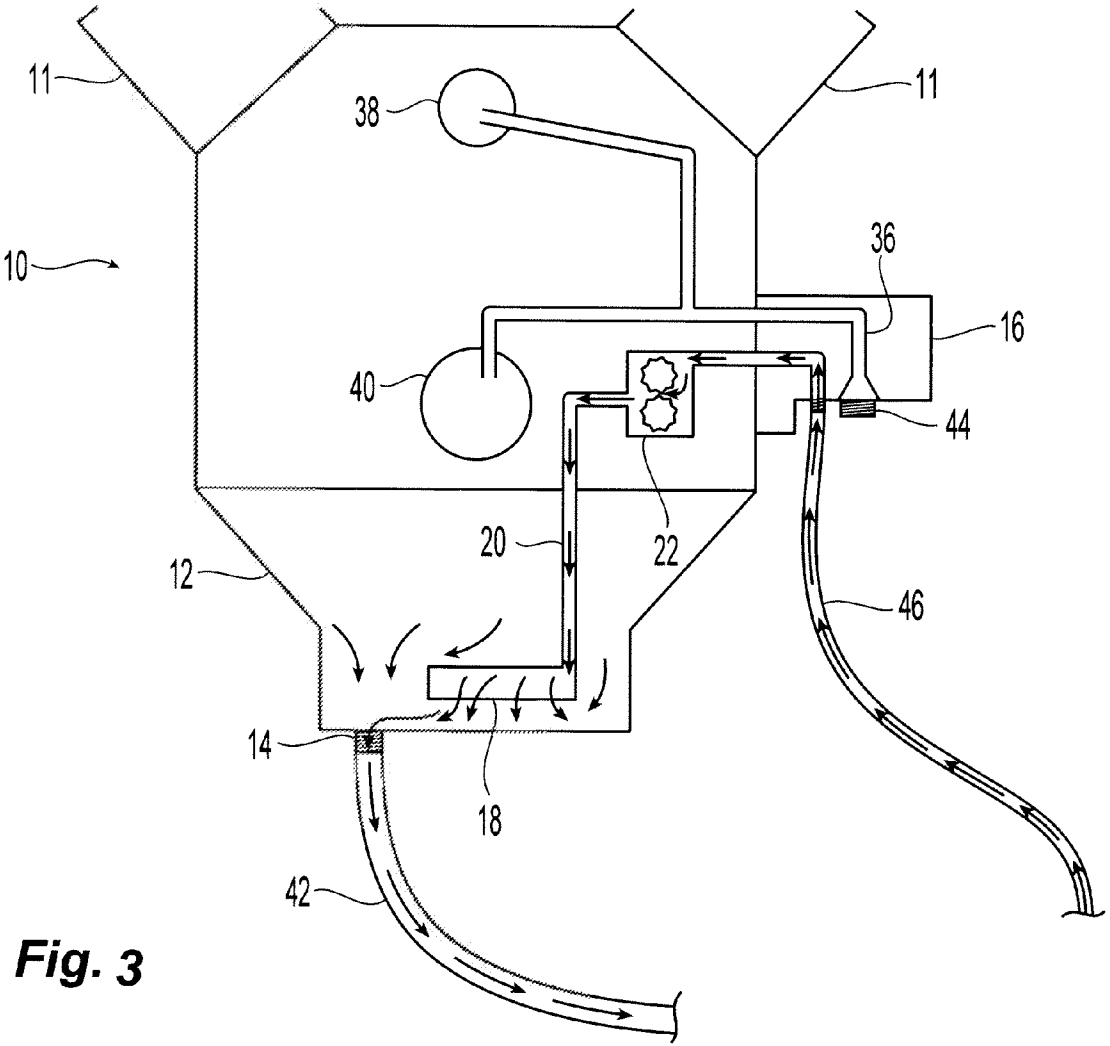
FIG. 3 is a cross-sectional schematic of an engine block, illustrating the path of cleaning fluid in accordance with a method of the present invention.

In an embodiment of the present invention illustrated in FIG. 3, oil is drained from oil pan 12 by removing oil plug 14. A predetermined amount of cleaning fluid is introduced into oil pan 12. Preferably, the cleaning fluid is introduced to oil pan 12 through oil pan plug 14. The cleaning fluid can be any manner of solvents, transmission fluid, detergents, 0-30 W oil or any combination thereof. Examples of appropriate solvents are products sold commercially such as GUNK® carburetor cleaner, Safe Clean, or Orange. The volume of cleaning fluid required depends upon the size of the engine 10 and oil pan 12. Preferably, a sufficient amount of cleaning fluid is provided to suspend the contaminants present in oil pan 12 in the cleaning fluid. In an exemplary preferred embodiment, the amount of cleaning fluid used generally may be about the same as the amount of oil used during normal engine operation.

Figure 4:
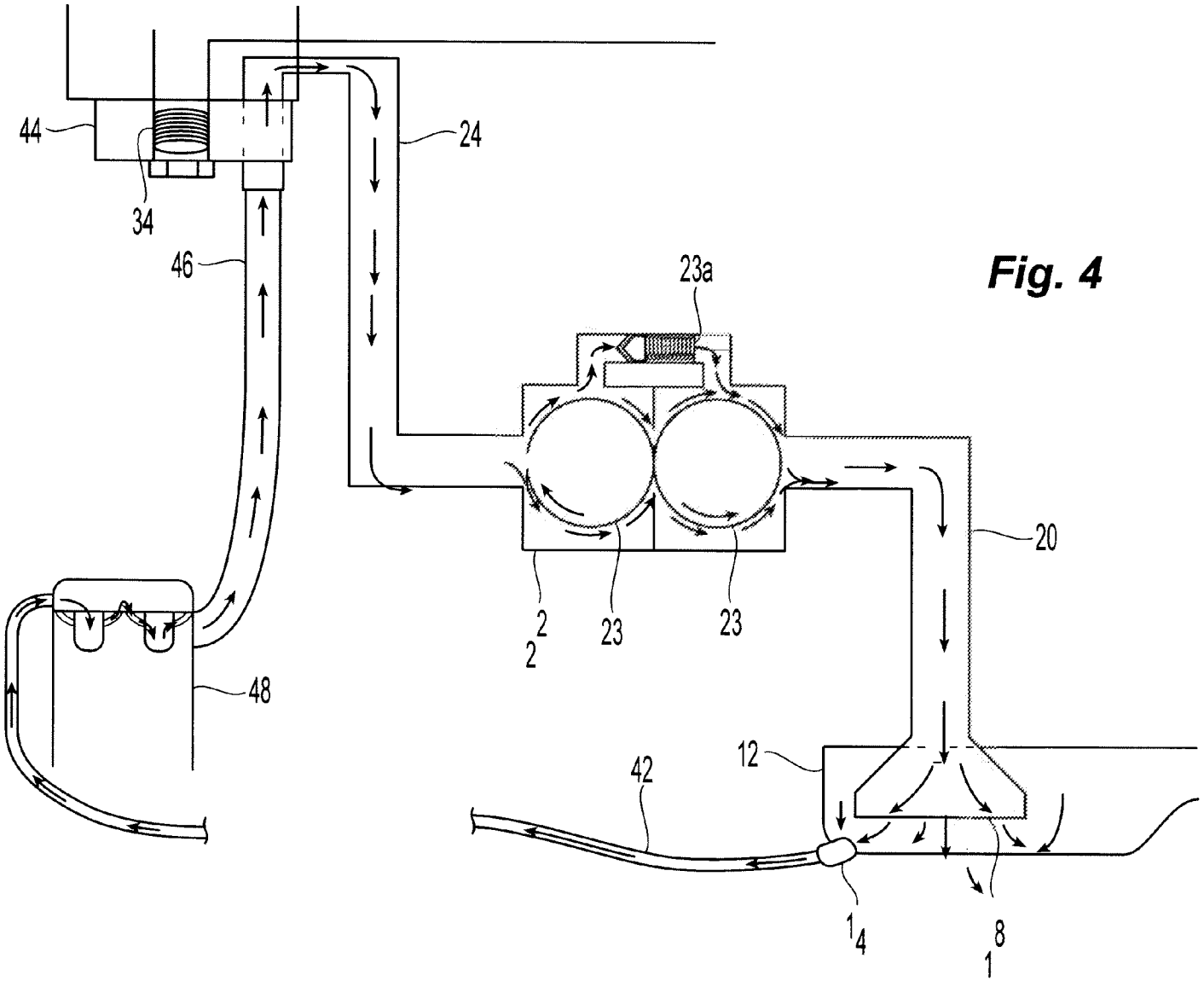
FIG. 4 is a partial cross-sectional view of an engine block, the oil pan and collector showing the flow of cleaning fluid in accordance with a method of the present invention.

An important aspect of the present invention is the creation of a closed circuit through which the cleaning fluid travels in a path that is reverse the flow of oil in an operating internal combustion engine. As shown in FIG. 4, pressure pump 48 causes the cleaning fluid to move under pressure in the circuit. Preferably, pressure pump 48 is a positive displacement pump. However, other pumps such as air, turbine, diaphragm, rotary gear, spur gear, or gerotor pumps may also be used. Using a single pressure pump advantageously facilitates regulation of the suction and positive pressure flow. The circuit may be hydraulic or pneumatic, and in a preferred embodiment described below the circuit is hydraulic/pneumatic.

To create the closed circuit, one end of a suction hose 42 is sealingly connected to oil pan plug 14 (or an adaptor fitted thereto) and the other end of suction hose 42 is connected to pressure pump 48, as shown in FIG. 4. Oil filter 30 is removed from filter boss 16 and an adaptor 44 seals connector 34, thereby preventing cleaning fluid from flowing into tube 36. A first end of pressure hose 46 is connected to opening 26. The second end of pressure hose 46 is attached to the pressure pump 48.

After the closed circuit is formed, pressure pump 48 is activated, causing the cleaning fluid to flow under pressure through the pressure hose 46 into oil pump 22. The gears 23 of oil pump 22 will not turn in the direction reverse its rotation during normal operating conditions, so the cleaning fluid builds up within the oil pump 22 until a sufficient amount of pressure is created to force open the pressure relief valve 23*a*. Typical pressure relief valves open at about 30 psi pressure, although less pressure may be required depending upon the tolerances of the valve and possible wear. Pressure pump 48 maintains a pressure sufficient to keep pressure relief valve 23*a* open during operation of the pneumatic cleaning process.

The cleaning fluid travels through oil uptake tube 20 to the oil strainer 18 and into oil pan 12. By forcing cleaning fluid under pressure backwards through oil pump 22, the oil strainer 18 now serves as a distributor head for the pressurized fluid to cover and clean the sump area on the bottom of oil pan 12. The cleaning fluid and contaminants exit oil pan 12 through oil plug 14 and travel through suction hose 42 to pump 48.

As the fluid under pressure flows in the hydraulic/pneumatic circuit, contaminants washed off of the surface of the inside oil pan area and the oil strainer restrictive materials are washed loose and sucked out through the suction side of the hydraulic/pneumatic circuit through suction hose 42 which is attached to oil plug 14.

Advantageously, an air injection valve may be added proximate to pump 48 for the operator to intermittently blast air into the liquid line to knock, dislodge, or blow any obstructions loose that may be accumulating in oil strainer 18. This process may assist in moving any loose material toward the suction line attached to oil plug 14 of oil pan 12. The air blast can also accelerate the flow of the cleaning fluid. Air blast pressure is dependant on available shop air pressure, but generally should be at a minimum of generally 45 psi, or at least greater than the pressure of the cleaning fluid. In some embodiments, the air blast is at a pressure of at least about 110 psi. Pressure above that point may be acceptable if regulated properly. Any safe fluid pressure capable of removing unwanted material in its path is acceptable.

In an embodiment of the invention, a vent to atmosphere (VTA) valve assembly is provided to vent the suction side of the pressure pump to atmosphere for a brief, timed instance, causing the pump to cavitate and condense the air bubbles, sending them through the oil pump and on through the suction tube and strainer, thereby aiding in removing restrictions from the strainer surface area. Optional heating of the cleaning fluid above 140° F. may be beneficial. Internal pulsation of the fluid is also desirable.

The course of the fluid/air/cavitation process is as follows: through oil filter boss 16, through by-pass valve 23*a* in oil pump 22, through tube 20 and oil strainer 18, into oil pan 12 and through suction hose 42. Pulsation of the fluid, heated or non-heated, is very beneficial as it does an excellent job of cleaning oil strainer 18 and bottom of oil pan 12.

In a preferred embodiment of the present invention, filter media is placed within suction hose transverse to the flow of cleaning fluid. The filter media may be removeably attached to suction hose 42 and may be periodically disconnected to remove contaminants from the cleaning fluid. Optionally, more than one filter media may be placed in the path of the hydraulic/pneumatic circuit.

Figure 5:
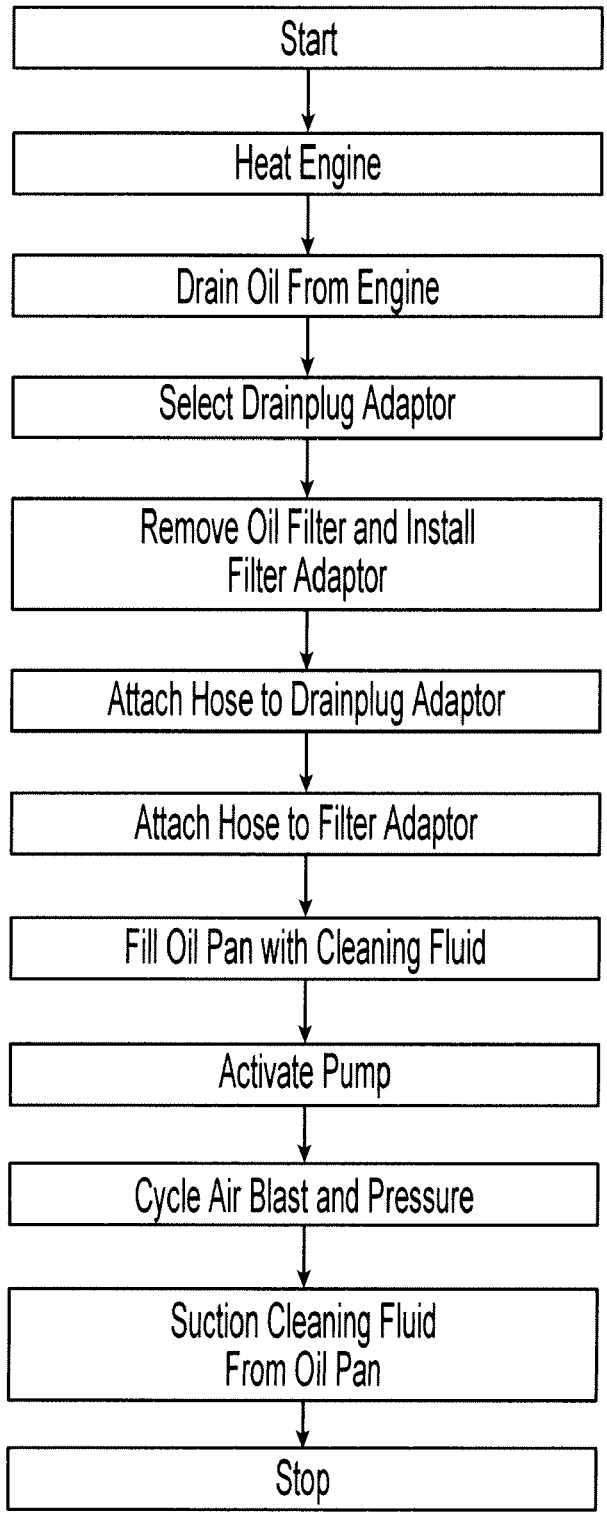
FIG. 5 is a flow chart showing a process of cleaning an oil strainer according to a preferred embodiment of the present invention.

As shown in FIG. 5, a process for cleaning an oil strainer according to a preferred embodiment of the present invention includes: heating the engine, draining oil from the engine, selecting a drainplug adaptor, removing the oil filter and installing a filter adaptor, attaching a hose to the drainplug adaptor, attaching the hose to the filter adaptor, filling the oil pan with cleaning fluid, activating the pump, cycling air blast and pressure, and suction cleaning fluid from the oil pan.

It will be appreciated by one skilled in the art that the invention is useful for removing oil sludge from an internal combustion engine. It may also be beneficial to perform the claimed method of at least twice, such as a second time after the engine has been allowed to operate and additional contaminants have moved from the top of the engine to the oil pan and oil strainer.

It will also be appreciated by one skilled in the art that the invention is particularly useful for reducing the amount of carry-over contamination that occurs during the oil change process. The invention permits a more complete removal of contaminants than oil change methods that rely upon gravity to evacuate the oil pan. In most oil pans found in internal combustion engines, oil plug 14 is not located at the lowest point of oil pan 12. Therefore, when oil is drained by gravity through oil plug 14, a substantial amount of dirty oil remains in oil pan 12. When clean oil is added to the engine, it contacts the contaminated oil and, as a result, itself becomes contaminated. The present invention substantially reduces the amount of carry-over oil contamination.

It will be obvious to one of ordinary skill in the art that various modifications and variations can be made without departing from the scope of the invention as defined in the following claims.

What is claimed is:

1. A method for cleaning an oil strainer in an oil pan of an internal combustion engine from which substantially all lubricant has been drained, the method comprising:

removing an oil filter from an oil filter boss of said engine and sealing a first opening on said boss through which oil flows to an engine block of said engine during normal operation of said engine;

connecting a first conduit to said oil pan at a plug opening thereof;

introducing a cleaning fluid into said oil pan;

connecting a second conduit to a second opening on said boss of said engine;

creating a closed circuit by disposing a pressure pump in communication with said first and second conduits, wherein said cleaning fluid is pumped and moves from said oil pan, through said second opening, through said oil strainer and back into said oil pan, wherein said cleaning fluid is pumped in a direction reverse that of oil flow in said engine as occurs during normal operation of said engine and wherein said cleaning fluid in said closed circuit flows at a pressure great enough to open a by-pass valve of an oil pump of said engine in said closed circuit and maintain said by-pass valve in an open position; and evacuating the cleaning fluid from the engine.

2. The method of claim 1 wherein said pressure pump is a positive displacement pump.

3. The method of claim 1, wherein said cleaning fluid in said circuit flows at a pressure of at least 30 psi.

4. The method of claim 1, further comprising using suction to drain said cleaning fluid from said oil pan.

5. The method of claim 1 wherein the cleaning fluid is introduced to the oil pan through said first conduit.

6. The method of claim 1, further comprising heating the engine prior to draining the lubricant from the internal combustion engine.

7. The method of claim 1, further comprising introducing an air blast to disrupt flow of cleaning fluid in the circuit.

8. The method of claim 7, wherein the air blast is at a pressure of at least 110 psi.

9. The method of claim 1, wherein the first conduit is in fluid communication with the second conduit.

10. The method of claim 1, wherein said first and second conduits are connected to said pressure pump.

11. A method of reducing oil sludge from an internal combustion engine having an engine block, oil pump and an oil strainer disposed with an oil pan, the method comprising:

draining substantially all lubricant from said engine;

removing an oil filter from an oil filter boss of said engine and sealing a first opening on said boss through which oil flows to said engine block during normal operation of said engine;

connecting a first conduit to said oil pan at a plug opening thereof;

introducing a cleaning fluid into said oil pan;

connecting a second conduit to a second opening on said boss of said engine;

creating a closed circuit through said conduits using a pressure pump, wherein said cleaning fluid moves from said oil pan, through said second opening, through said oil strainer and back into said oil pan, wherein said cleaning fluid is pumped in a direction reverse that of oil flow in said engine as occurs during normal operation of said engine; and evacuating the cleaning fluid from the engine;

wherein said cleaning fluid in said circuit flows at a pressure great enough to open a by-pass valve of the oil pump and maintain said by-pass valve in an open position.

12. The method of claim 11 wherein said pressure pump is a positive displacement pump.

13. The method of claim 11, wherein said cleaning fluid in said circuit flows at a pressure of at least about 30 psi.

14. The method of claim 11 wherein the cleaning fluid is introduced to the oil pan through said first conduit.

15. A method for reducing carry-over oil contamination during an oil changing process for an internal combustion engine having an engine block, oil pump, oil strainer and an oil pan, the method comprising:

draining substantially all lubricant from said engine;

removing an oil filter from an oil filter boss of said engine and sealing a first opening on said boss through which oil flows to said engine block during normal operation of said engine;

connecting a first conduit to said oil pan at a plug opening thereof;

introducing a cleaning fluid into said oil pan;

connecting a second conduit to a second opening on said boss of said engine;

creating a closed circuit with a pressure pump wherein said cleaning fluid moves from said oil pan, through said second opening, through said oil strainer and back into said oil pan, wherein said cleaning fluid is pumped in a direction reverse that of oil flow in said engine as occurs during normal operation of said engine, and wherein said cleaning fluid in said closed circuit flows at a pressure great enough to open a by-pass valve of the oil pump while in said closed circuit and maintain said by-pass valve in an open position;

filtering said cleaning fluid through a filter media disposed in said first conduit;

evacuating the cleaning fluid from the engine; and introducing a predetermined amount of clean oil to the engine.

16. The method of claim 15 wherein said pressure pump is a positive displacement pump.

17. The method of claim 15, wherein said cleaning fluid in said circuit flows at a pressure of at least about 30 psi.

18. The method of claim 15, wherein said first and second conduits are connected to said pressure pump.

19. A method of cleaning an oil flow path through components in an internal combustion engine, the method comprising:

removing an oil filter from an oil filter boss of the engine;

draining oil from the oil flow path;

after draining the oil, creating a closed circuit between a pressure pump and the components including an oil pump, an oil strainer, and an oil pan, with the closed circuit comprising the oil flow path;

pumping cleaning fluid through the closed circuit using the pressure pump, wherein the cleaning fluid is pumped in a direction reverse that of oil flow in the oil flow path as occurs during normal operation of the engine, and wherein the cleaning fluid in the closed circuit flows at a pressure great enough to open a by-pass valve of the oil pump and maintain the by-pass valve in an open position during the pumping;

wherein the pressure pump circulates the cleaning fluid from the oil pan through a plug opening thereof, through an opening disposed in the oil filter boss, through the oil pump, through the oil strainer, and then back to the oil pan; and wherein the oil filter boss further includes a passage in communication with cams and mains of the engine, and the passage is blocked to prevent cleaning fluid from flowing to the cams and the mains.

20. The method of claim 19, further comprising:

evacuating the cleaning fluid from the engine.

21. The method of claim 19, wherein the closed circuit comprises a first conduit connecting the oil pan to the pressure pump and a second conduit connecting the pressure pump to the opening disposed in the oil filter boss of the engine.

22. The method of claim 19, further comprising pulsating the cleaning fluid.

23. The method of claim 19, further comprising heating the cleaning fluid.

24. The method of claim 19, further comprising injecting gas into the cleaning fluid.

25. The method of claim 19, further comprising filtering contaminants from the cleaning fluid while the cleaning fluid circulates through the closed circuit.

26. A method for cleaning an oil strainer in an internal combustion engine, the method comprising:

draining oil from the engine;

after draining the oil, creating a closed circuit between a pressure pump, an oil pump, an oil strainer, and an oil pan, with the closed circuit in part created by removing an oil filter from an oil filter boss of the engine and sealing a first opening on the boss through which oil flows to an engine block of the engine during normal operation of the engine;

pumping cleaning fluid through the closed circuit using the pressure pump, wherein the cleaning fluid is pumped in a direction reverse that of oil flow through the oil pump as occurs during normal operation of the engine, and wherein the cleaning fluid in the closed circuit flows at sufficient pressure to open a by-pass valve of the oil pump and maintain the by-pass valve in an open position during the pumping;

wherein the pressure pump circulates the cleaning fluid from the oil pan through a plug opening thereof, through a second opening in the oil filter boss, through the oil pump, through the oil strainer, and then back to the oil pan.

27. The method of claim 26, further comprising:

coupling an adaptor to the oil filter boss to seal the first opening.

28. The method of claim 26, further comprising:

coupling an adaptor to the second opening in the oil filter boss and permitting circulation of cleaning fluid therethrough.

29. The method of claim 26, wherein the cleaning fluid in the closed circuit flows at a pressure of at least about 30 psi.

30. The method of claim 1, further comprising:

coupling an adaptor to the oil filter boss to seal the first opening.

31. The method of claim 11, further comprising:

coupling an adaptor to the oil filter boss to seal the first opening.

32. The method of claim 15, further comprising:

coupling an adaptor to the oil filter boss to seal the first opening.

33. The method of claim 19, further comprising:

coupling an adaptor to the oil filter boss to block the passage.

* * * * *